US010529268B2

(12) United States Patent
Zhang et al.

(10) Patent No.: US 10,529,268 B2
(45) Date of Patent: Jan. 7, 2020

(54) PIXEL ARRAY, DISPLAY DEVICE AND DISPLAY METHOD THEREOF

(71) Applicant: BOE TECHNOLOGY GROUP CO., LTD., Beijing (CN)

(72) Inventors: Xiaomang Zhang, Beijing (CN); Xue Dong, Beijing (CN); Jing Lv, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/783,620

(22) Filed: Oct. 13, 2017

(65) Prior Publication Data

US 2018/0211578 A1 Jul. 26, 2018

(30) Foreign Application Priority Data

Jan. 25, 2017 (CN) ..... 2017 1 0063246

(51) Int. Cl.
*G09G 5/00* (2006.01)
*G09G 3/20* (2006.01)

(52) U.S. Cl.
CPC ... *G09G 3/2003* (2013.01); *G09G 2300/0452* (2013.01); *G09G 2320/0666* (2013.01)

(58) Field of Classification Search
CPC ..... G09G 3/2003; G09G 2320/0666; G09G 2300/0452
See application file for complete search history.

(56) References Cited

U.S. PATENT DOCUMENTS

2006/0038953 A1* 2/2006 Moriya ..... G02F 1/133514 349/144
2010/0283807 A1* 11/2010 Hsieh ..... G09G 3/3607 345/694

(Continued)

FOREIGN PATENT DOCUMENTS

CN 105118421 12/2015 ..... G09G 3/20
CN 105118421 A 12/2015 ..... G09G 3/20

(Continued)

OTHER PUBLICATIONS

First Office Action for Chinese Application No. 201710063246.7, dated Dec. 27, 2018, 8 Pages.

*Primary Examiner* — Jonathan A Boyd
(74) *Attorney, Agent, or Firm* — Brooks Kushman P.C.

(57) ABSTRACT

The present disclosure provides a pixel array, a display device and a display method thereof. The pixel array includes first display blocks and second display blocks arranged in an array. The first display blocks and the second display blocks are arranged by turns in a first direction. Each display block includes a first subpixel, a second subpixel, a third subpixel, a fourth subpixel and a fifth subpixel arranged in two adjacent lines, the first subpixel, the second subpixel and the third subpixel are arranged in a line, and the fourth subpixel and the fifth subpixel are arranged in a line. A gap between any two adjacent subpixels in an $i^{th}$ line is aligned in an extension direction of the gap with a subpixel in an $(i+1)^{th}$ line.

2 Claims, 9 Drawing Sheets

(56) References Cited

U.S. PATENT DOCUMENTS

| | | | | |
|---|---|---|---|---|
| 2016/0035266 | A1* | 2/2016 | Li | G09G 3/2003 345/205 |
| 2016/0155398 | A1* | 6/2016 | Yang | G09G 3/3607 345/87 |
| 2016/0232829 | A1 | 8/2016 | Ahn et al. | |
| 2017/0004780 | A1* | 1/2017 | De Greef | G09G 3/348 |
| 2017/0092175 | A1 | 3/2017 | Guo et al. | |
| 2017/0343867 | A1* | 11/2017 | Su | G02F 1/134336 |

FOREIGN PATENT DOCUMENTS

| | | | | |
|---|---|---|---|---|
| CN | 105206215 | | 12/2015 | G09G 3/20 |
| CN | 105206215 | A | 12/2015 | |
| CN | 105206215 | A | 12/2015 | G09G 3/20 |
| CN | 105869557 | | 8/2016 | G09G 3/20 |
| CN | 105869557 | A | 8/2016 | |
| CN | 105869557 | A | 8/2016 | G09G 3/20 |
| CN | 106267627 | | 1/2017 | G09G 3/20 |
| CN | 106297627 | A | 1/2017 | |
| CN | 106297627 | A | 1/2017 | G09G 3/20 |
| WO | 2006038953 | | 2/2006 | G02F 1/1343 |

* cited by examiner

PIXEL ARRAY, DISPLAY DEVICE AND DISPLAY METHOD THEREOF

CROSS-REFERENCE TO RELATED APPLICATIONS

This application claims priority to Chinese Patent Application No. 201710063246.7 filed on Jan. 25, 2017, which is incorporated herein by reference in its entirety.

TECHNICAL FIELD

The present disclosure relates to the field of display technology, in particular to a pixel array, a display device and a display method thereof.

BACKGROUND

For a display panel, five primary colors are capable of providing a higher color gamut as compared with three primary colors. Recently, the application of five primary colors in the display panel has attracted more and more attentions.

However, when the display panel displays an image using conventional five primary colors, e.g., red, green, blue, yellow and cyan, pixel units are arranged in a matrix, and each pixel unit includes subpixels of these five colors arranged in a line. In this way, in the pixel unit, the subpixels of the five colors are spaced apart from each other at a relatively large distance. The dispersed arrangement of the five colors results in an uneven distribution of the colors for the image.

SUMMARY

In an aspect, the present disclosure provides in some embodiments a pixel array, including first display blocks and second display blocks arranged in an array. The first display blocks and the second display blocks are arranged by turns in a first direction. Each of the first display blocks and the second display blocks includes a first subpixel, a second subpixel, a third subpixel, a fourth subpixel and a fifth subpixel arranged in two adjacent lines, the first subpixel, the second subpixel and the third subpixel are arranged in a line, and the fourth subpixel and the fifth subpixel are arranged in a line. In a group of the first display block and the second display block arranged adjacent to each other in the first direction, the first subpixel, the second subpixel and the third subpixel of the first display block and the fourth subpixel and the fifth subpixel of the second display block are arranged in a line, and the fourth subpixel and the fifth subpixel of the first display block and the first subpixel, the second subpixel and the third subpixel of the second display block are arranged in a line. A gap between any two adjacent subpixels in an $i^{th}$ line is aligned in an extension direction of the gap with a subpixel in an $(i+1)^{th}$ line, where i is a positive integer.

In a possible embodiment of the present disclosure, the first subpixel, the second subpixel and the third subpixel of each of the first display blocks and the second display blocks are arranged in an identical order, and the fourth subpixel and the fifth subpixel of each of the first display blocks and the second display blocks are arranged in an identical order.

In a possible embodiment of the present disclosure, the display blocks arranged in a line and in a direction perpendicular to the first direction are the first display blocks or the second display blocks.

In a possible embodiment of the present disclosure, the gap between the two adjacent subpixels in the $i^{th}$ line is aligned in the extension direction of the gap with a midpoint of a first side of the subpixel in the $(i+1)^{th}$ line, and the first side of the subpixel in the $(i+1)^{th}$ line is one of sides extending in the first direction that is located adjacent to a side of the subpixel in the $i^{th}$ line.

In a possible embodiment of the present disclosure, a ratio of a length of each subpixel in the first direction to a length of the subpixel in a second direction perpendicular to the first direction is within the range of 0.3 to 0.5.

In a possible embodiment of the present disclosure, the ratio of the length of each subpixel in the first direction to the length of the subpixel in the second direction is 0.4.

In a possible embodiment of the present disclosure, each display block includes a red subpixel, a green subpixel, a blue subpixel, a cyan subpixel, and a yellow subpixel, and the green subpixel and the yellow subpixel are arranged in different lines.

In a possible embodiment of the present disclosure, the first direction is a horizontal direction.

In another aspect, the present disclosure provides in some embodiments a display device including the above-mentioned pixel array.

In yet another aspect, the present disclosure provides in some embodiments a display method for the above-mentioned display device, the display device including M*N display blocks, and the display method including: acquiring five-primary-color pixel data of a to-be-displayed image, the five-primary-color pixel data including data of M*N pixels, the data of each pixel including five-primary-color pixel values, each pixel corresponding to one display block of the display device; scanning subpixels of the display device line by line; and applying to each subpixel an electric signal corresponding to a pixel value of the subpixel during scanning a line of the subpixels. The pixel value of the subpixel is a pixel value of a subpixel of a color identical to the subpixel in the data of the pixel corresponding to the display block to which the subpixel belongs.

In still yet another aspect, the present disclosure provides in some embodiments a display method for the above-mentioned display device, the display device including M*2N display blocks, every five adjacent subpixels of the display device in a row direction forming an actual pixel unit group, every 2.5 adjacent subpixels in the actual pixel unit group forming an actual pixel unit, and the display method including: acquiring five-primary-color pixel data of a to-be-displayed image, the five-primary-color pixel data including data of 2M*2N pixels, the data of each pixel including five-primary-color pixel values, each pixel corresponding to an actual pixel unit of the display device; converting the data of the 2M*2N pixels into pixel values of 2M*5N subpixels; scanning the subpixels of the display device row by row; and applying to each subpixel an electric signal corresponding to the pixel value of the subpixel, during scanning a row of the subpixels.

In a possible embodiment of the present disclosure, the step of converting the data of the 2M*2N pixels into the pixel values of the 2M*5N subpixels includes performing a weighted addition of the pixels values of subpixels of an identical specific color in the data of two pixels corresponding to one actual pixel unit group to acquire the pixel value of the subpixels of the specific color in the actual pixel unit group, and the specific color is a first primary color, a second primary color, a third primary color, a fourth primary color or a fifth primary color.

BRIEF DESCRIPTION OF THE DRAWINGS

In order to illustrate the technical solutions of the present disclosure or the related art in a clearer manner, the drawings mentioned in the description of the present disclosure or the related art will be described hereinafter briefly. Evidently, the following drawings merely relate to some embodiments of the present disclosure, and based on these drawings, a person skilled in the art may obtain other drawings without any creative effort.

Figure 1A:
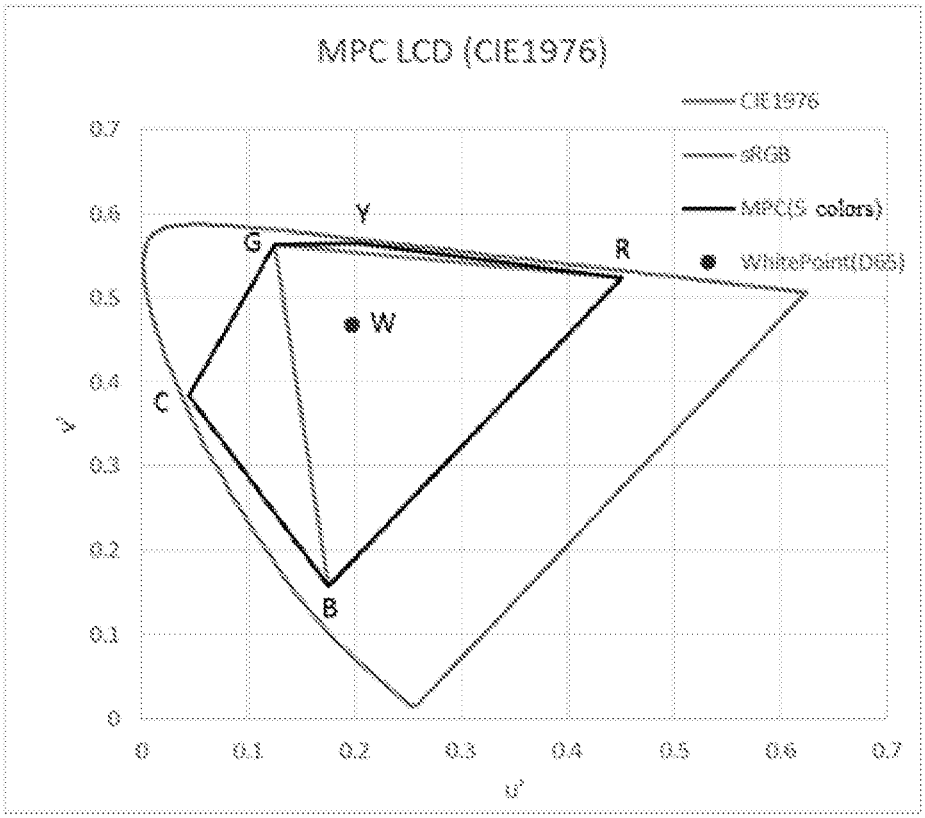
FIG. 1*a* is a schematic view showing the color gamut of multi-primary-color display in the related art.

Reference numerals:

| | | | |
|---|---|---|---|
| 10, 10' | first display block | 100 | pixel unit |
| 101 | first subpixel | 102 | second subpixel |
| 103 | third subpixel | 104 | fourth subpixel |
| 105 | fifth subpixel | 20 | second display block |
| 30, 30' | actual pixel unit | 300 | actual pixel unit group |

DETAILED DESCRIPTION

The technical solutions of the embodiments of the present disclosure will be described hereinafter in a clear and complete manner in conjunction with the drawings. Evidently, the following embodiments are merely part of and not all of the embodiments of the present disclosure. Based on these embodiments, a person skilled in the art may, without any creative effort, obtain other embodiments, which also fall within the scope of the present disclosure.

As shown in FIG. 1*a*, a color gamut produced by conventional three primary colors, i.e., red, green and blue, is a region enclosed by a triangle RGB, and a color gamut produced by five primary colors, i.e., red, green, blue, yellow and cyan, is a region enclosed by RYGCB. Hence, the latter has a larger area than the former.

Figure 1B:
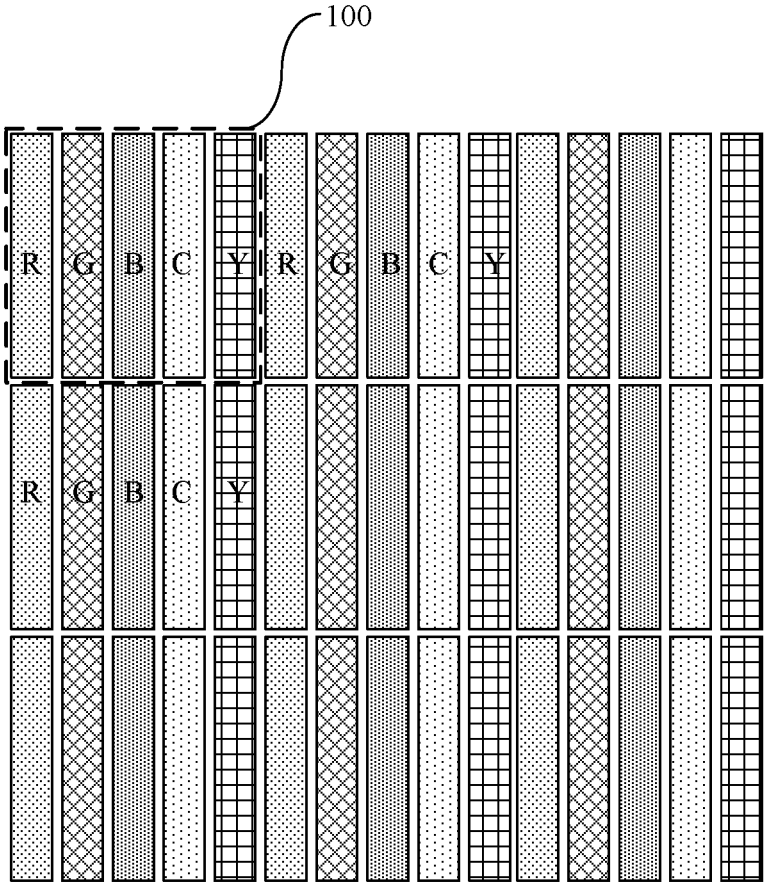
FIG. 1*b* is a schematic view showing a five-primary-color pixel array in the related art.

As shown in FIG. 1*b*, which shows a conventional five-primary-color pixel array, pixel units 100 are arranged in a matrix, and each pixel unit includes subpixels of five primary colors (R, G, B, C and Y) arranged in a line.

Figure 2:
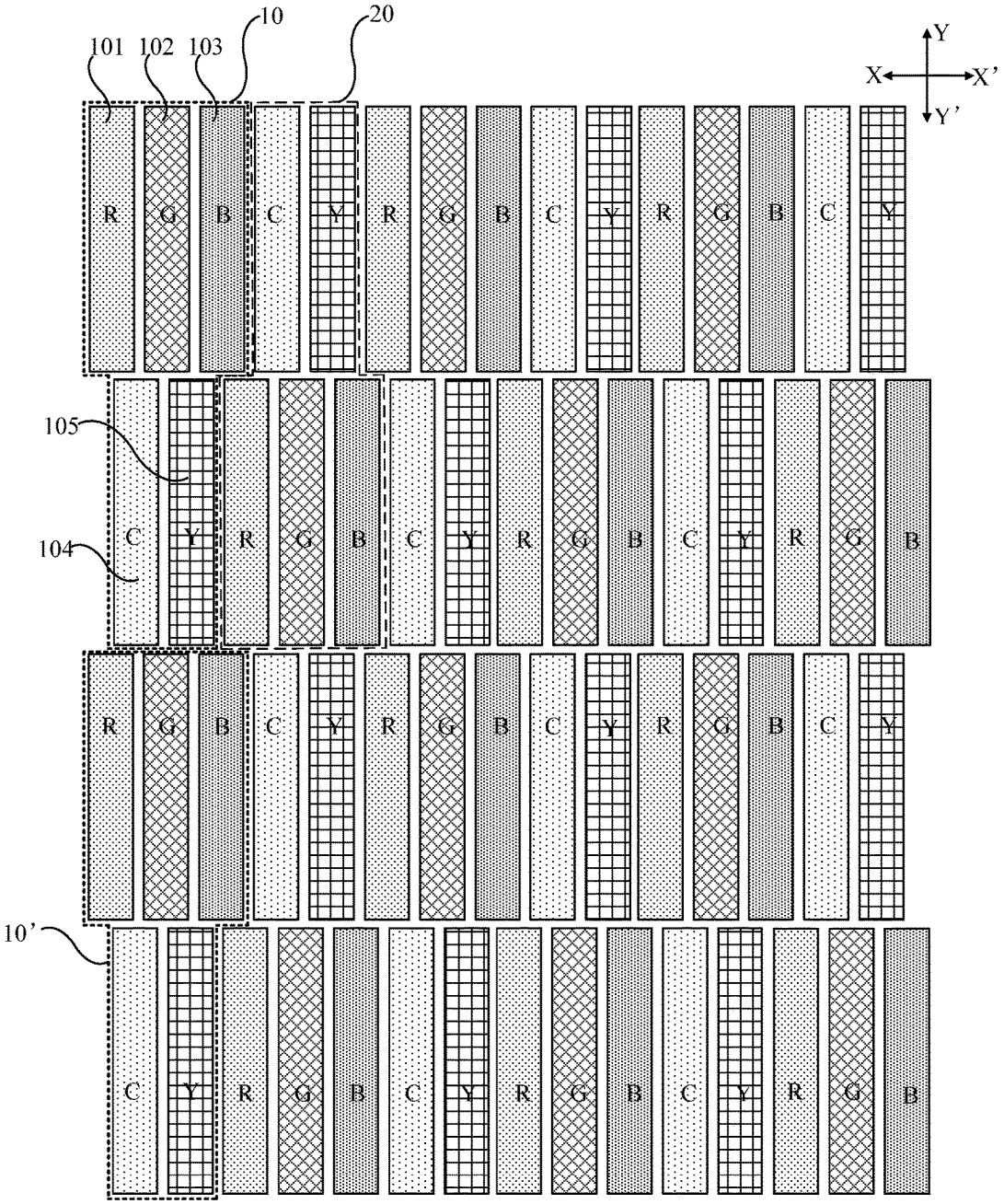
FIG. 2 is a schematic view showing a five-primary-color pixel array according to some embodiments of the present disclosure.

The present disclosure provides in some embodiments a pixel array which, as shown in FIG. 2, includes first display blocks 10 and second display blocks 20 arranged in an array. The first display blocks 10 and the second display blocks 20 are arranged by turns in a first direction X-X'. Each display block includes a first subpixel 101, a second subpixel 102, a third subpixel 103, a fourth subpixel 104 and a fifth subpixel 105 arranged in two adjacent rows, e.g., a red subpixel (R), a green subpixel (G), a blue subpixel (B), a cyan subpixel (C) and a yellow subpixel (Y), or any other five-primary-color subpixels which are not be particularly defined herein. As compared with conventional subpixels of three primary colors (R, G, and B), the subpixels of five primary colors may provide a larger color gamut in displaying.

Based on the above, as shown in FIG. 2, in each display block, the first subpixel 101, the second subpixel 102 and the third subpixel 103 are arranged in the same row, the fourth subpixel 104 and the fifth subpixel 105 are arranged in the same row, and the first direction X-X' is a row direction of the subpixels. Among the five-primary-color subpixels including the red subpixel (R), the green subpixel (G), the blue subpixel (B), the cyan subpixel (C) and the yellow subpixel (Y), the green subpixel (G) and the yellow subpixel (G) are relatively brighter, so in a possible embodiment of the present disclosure, the green subpixel (G) and the yellow subpixel (Y) in each display block may be arranged in different rows, so as to improve the brightness distribution of the entire display block.

As shown in FIG. 2, in a group of the first display block 10 and the second display block 20 arranged adjacent to each other in the first direction X-X', the first subpixel 101, the second subpixel 102 and the third subpixel 103 of the first display block 10 and the fourth subpixel 104 and the fifth subpixel 105 of the second display block 20 are arranged in the same row, and the fourth subpixel 104 and the fifth subpixel 105 of the first display block 10 and the first subpixel 101, the second subpixel 102 and the third subpixel 103 of the second display block 20 are arranged in to the same row.

In addition, as shown in FIG. 2, a gap between any two adjacent subpixels in an $i^{th}$ row is aligned in its extension direction with a subpixel in an $(i+1)^{th}$ row, where i is a positive integer. In this way, the subpixels in each display block may be distributed concentratedly.

Figure 3:
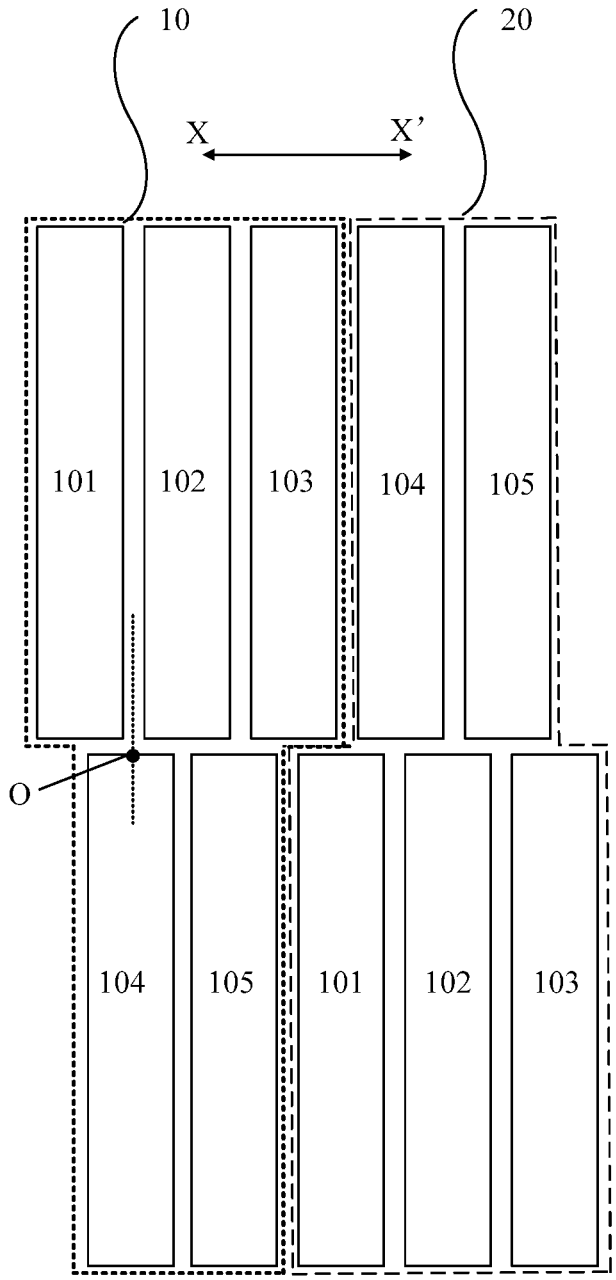
FIG. 3 is a schematic view showing the topical subpixel distribution of the five-primary-color pixel array according to some embodiments of the present disclosure.

In order to enable the subpixels in each display block to be distributed concentratedly to the greatest extent, as shown in FIG. 3 (where two rows of subpixels are illustrated as an example), the gap between the two adjacent subpixels in the $i^{th}$ row (a first row in FIG. 3) is aligned in its extension direction with a midpoint O of a first side of a subpixel in the $(i+1)^{th}$ row (a second row in FIG. 3), and the first side of the subpixel in the $(i+1)^{th}$ row is one of the sides extending in the first direction X-X' that is located adjacent to a side of the subpixel in the $i^{th}$ row.

It should be appreciated that, the gap is of a relatively small width and thus may be approximately deemed as a line, as long as the line is aligned in its extension direction with the midpoint O of the first side of the subpixel in a next row. Certainly, in the event that the gap is of a relatively large width which cannot be omitted, a central line of the gap needs to be aligned in its extension direction with the midpoint O of the first side of the subpixel in the next row, so as to ensure the concentrated distribution of the subpixels in each display block to the greatest extent.

In summary, each display block includes the first subpixel, the second subpixel, the third subpixel, the fourth subpixel and the fifth subpixel. The first subpixel, the second subpixel and the third subpixel in each display block are arranged in the same row, and the fourth subpixel and the fifth subpixel in each display block are arranged in the same row. The gap between any two adjacent subpixels in the $i^{th}$ row is aligned in its extension direction with the subpixel in the $(i+1)^{th}$ row. For each display block, the first subpixel, the second subpixel and the third subpixel are arranged opposite to the fourth subpixel and the fifth subpixel in an adjacent row in the extension direction of the gap, so the five subpixels in each display block may be distributed concentratedly. As a result, when displaying an image using the pixel array, it is possible to ensure the uniform distribution of the colors while providing a large color gamut, thereby improving a display effect.

Based on the above, in order to further improve the color uniformity of the entire pixel array during displaying, as shown in FIG. 3, the first subpixel 101, the second subpixel 102 and the third subpixel 103 of each display block are arranged in an identical order, and the fourth subpixel 104 and the fifth subpixel 105 of each display block are arranged in an identical order. Taking the first display block 10 and the second display block 20 in FIG. 3 as an example, the first subpixel 101, the second subpixel 102 and the third subpixel 103 of the first display block 10 are arranged in an order identical to the first subpixel 101, the second subpixel 102 and the third subpixel 103 of the second display block 20, and so do the fourth subpixels 104 and the fifth subpixels 105. In this way, for two adjacent display blocks, an identical distance is kept between the subpixels of an identical color, so it is possible to improve the color uniformity of the entire pixel array during displaying.

In order to further improve the color uniformity of the entire pixel array during displaying, as shown in FIG. 2, the display blocks arranged in the same column and in a second direction Y-Y' perpendicular to the first direction X-X' are the first display blocks 10 or the second display blocks 20, e.g., the first display blocks (10 and 10') in FIG. 2. In this way, for the display blocks adjacent to each other in the second direction Y-Y', an identical distance is kept between the subpixels of an identical color, so it is possible to improve the color uniformity of an image displayed by the entire pixel array.

Based on the above, in order to display the image normally, it is necessary to enable a minimum display unit of the pixel array to be of a square shape, i.e., a pixel unit 100 in the pixel array needs to be of a square shape. The pixel unit 100 is a minimum display unit consisting of subpixels of all the primary colors. In this way, as compared with the pixel unit 100 of the conventional three-primary-color pixel array in part (b) of FIG. 4, for the pixel unit 100 of the five-primary-color pixel array in part (a) of FIG. 4, a width of each subpixel in the five-primary-color pixel array is ⅗ of a width of the subpixel in the three-primary-color pixel array in the event that the pixel units 100 are of an identical area and the subpixels have an identical height, so higher manufacture requirements is made for the manufacture of the five-primary-color pixel array. In addition, in the five-primary-color pixel array, an area of each subpixel is ⅗ of that of the subpixel in the three-primary-color pixel array, so the light transmissivity of each subpixel is relatively low. Furthermore, a pixel data volume of each pixel unit 100 in the five-primary-color pixel array is 5/3 of a pixel data volume of each pixel unit 100 in the three-primary-color pixel array, i.e., during displaying, a data transmission volume of the five-primary-color pixel array is greater than that of the three-primary-color pixel array, resulting in higher power consumption which is adverse to a portable display device.

It should be appreciated that, the above-mentioned pixel unit 100 is acquired by dividing the structure of the pixel array theoretically, i.e., it may not necessarily be in a one-to-one correspondence with pixel data of the image.

Figure 5:
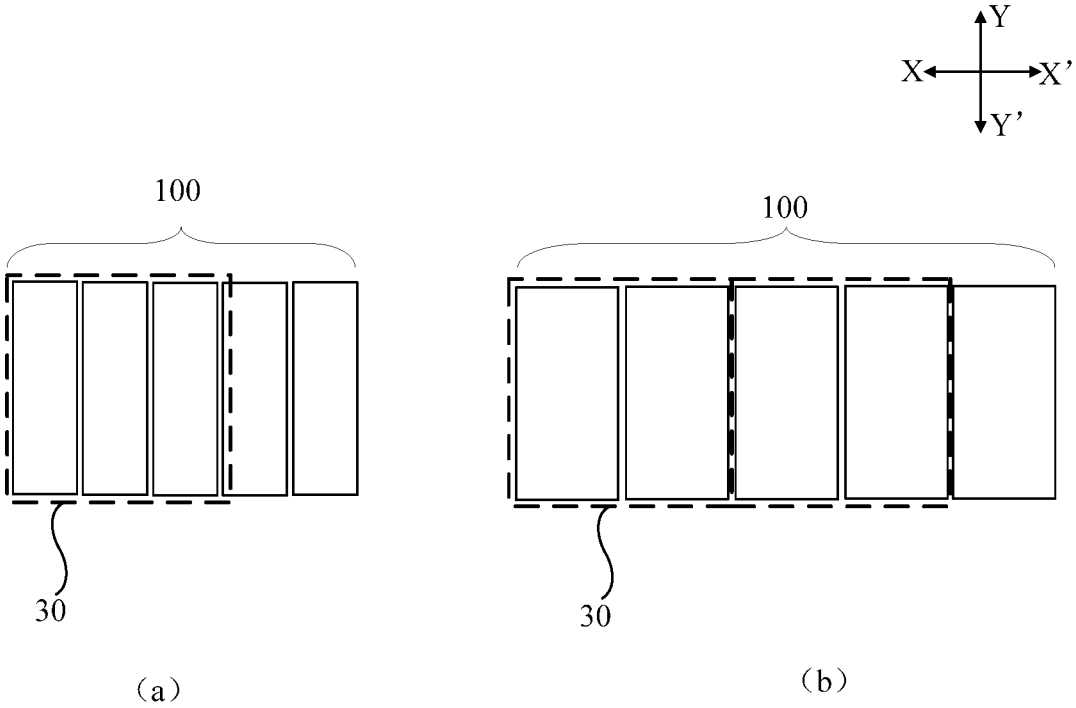
FIG. 5 is a schematic view showing two five-primary-color actual pixel units according to some embodiments of the present disclosure.

To solve the above-mentioned problem, in a possible embodiment of the present disclosure, as shown in FIG. 5, a ratio of a length of each subpixel in the first direction X-X' to a length of the subpixel in the second direction Y-Y' is within the range of 0.3 to 0.5. Certainly, this is ratio is set in the event that the width of the gap between the two adjacent subpixels is omitted. The second direction Y-Y' is perpendicular to the first direction X-X'. In this case, the pixel unit 100 is of a non-square shape.

To be specific, as shown in (a) and (b) of FIG. 5, the pixel unit 100 is of a non-square shape. In this case, a minimum square display unit for ensuring the normal display is an actual pixel unit 30. As compared with the situation in parts (a) and (b) of FIG. 4 where the pixel unit 100 corresponds to one actual pixel unit 30, the pixel unit 100 in FIG. 4 is not equivalent to the actual pixel unit 30.

Certainly, in the above-mentioned case, as shown in FIG. 5, each actual pixel unit 30 merely includes parts of the subpixels in one pixel unit 100. In the event that the data of pixels of one image is displayed by the actual pixel unit 30, subpixels corresponding to parts of the primary-color pixel values may not be missed. Hence, during displaying, it is necessary to perform a rendering operation on the data of the pixels of the image, so that the subpixels in an identical color in an adjacent actual pixel unit 30 are used as the missing subpixels corresponding to parts of the primary-color pixel values.

The ratio of the length of each subpixel in the first direction X-X' to the length of the subpixel in the second direction Y-Y' will be described hereinafter in detail.

Figure 4:
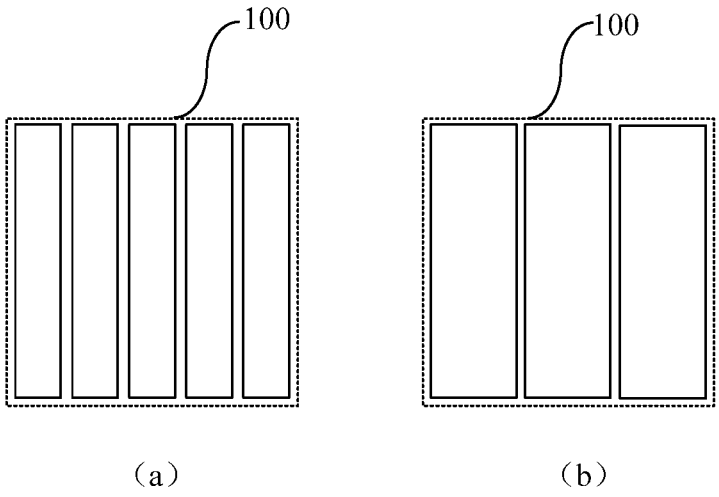
FIG. 4 is a schematic view showing a five-primary-color pixel unit and a three-primary-color pixel unit according to some embodiments of the present disclosure.

As shown in (a) of FIG. 5, in the event that the ratio of the length of each subpixel in the first direction X-X' to the length of the subpixel in the second direction Y-Y' is 0.3, i.e., a ratio of a height of the subpixel to a width of the subpixel is 0.3, one actual pixel unit 30 may include approximately 3 subpixels, so the resultant five-primary-color pixel array is advantageous, to some extent, over the five-primary-color pixel array as shown in part (a) of FIG. 4, but substantially identical to the three-primary-color pixel array in part (b) of FIG. 4, in terms of the manufacture accuracy requirement, the light transmissivity of the subpixel and the data transmission volume of each pixel. In order to effectively lower the manufacture accuracy requirement, improve the light transmissivity of the subpixel and reduce the data transmission volume of each pixel, in a possible embodiment of the present disclosure, the ratio of the length of each subpixel in the first direction X-X' to the length of the subpixel in the second direction Y-Y' may be greater than 0.3.

As shown in part (b) of FIG. 5, in the event that the ratio of the length of each subpixel in the first direction X-X' to the length of the subpixel in the second direction Y-Y' is 0.5, i.e., a ratio of the height of the subpixel to the width of the subpixel is 0.5, one actual pixel unit 30 includes two subpixels, for the resultant five-primary-color pixel array as compared with the three-primary-color pixel array in (b) of FIG. 4, the manufacture accuracy requirement is obviously lowered, the light transmissivity of the subpixel is increased, and the data transmission volume of each pixel is reduced. However, in the event that one actual pixel unit 30 includes less than two subpixels, a resolution of the image may be adversely affected. Hence, in a possible embodiment of the present disclosure, the ratio of the length of each subpixel in the first direction X-X' to the length of the subpixel in the second direction Y-Y' may be smaller than 0.5.

In sum, the ratio of the length of each subpixel in the first direction X-X' to the length of the subpixel in the second direction Y-Y' may be within the range of 0.3 to 0.5.

Figure 6:
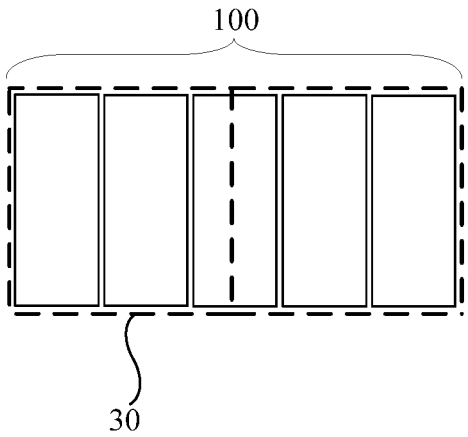
FIG. 6 is a schematic view showing another five-primary-color actual pixel unit according to some embodiments of the present disclosure.

Further, as shown in FIG. 6, the ratio of the length of each subpixel in the first direction X-X' to the length of the subpixel in the second direction Y-Y' may be 0.4.

In this case, one actual pixel unit 30 may include 2.5 subpixels. As compared with the three-primary-color pixel array in part (b) of FIG. 4, in the event that the subpixels are of an identical height, the width of the subpixel in the five-primary-color pixel array may be 6/5 of the width of the subpixel in the three-primary-color pixel array, i.e., the width of the subpixel may be increased, so it is possible to lower the accuracy requirement on the manufacture process. In addition, an area of each subpixel in the five-primary-color pixel array may be 6/5 of that of the subpixel in the three-primary-color pixel array, so it is possible to increase the light transmissivity of each subpixel. Further, the pixel data volume of each actual pixel unit 30 in the five-primary-color pixel array may be 5/6 of that of the actual pixel unit (i.e., the pixel unit 100) in the three-primary-color pixel array, so it is possible to reduce the data transmission volume of the pixel.

The present disclosure further provides in some embodiments a display device including any type of the above-mentioned pixel arrays. The structure and the beneficial effect of the pixel arrays have been described above, and thus will not be repeated herein.

The present disclosure further provides in some embodiments a display method for the above-mentioned display device. The display device includes M*N display blocks, where M represents the number of rows, and N represents the number of columns.

Figure 7:
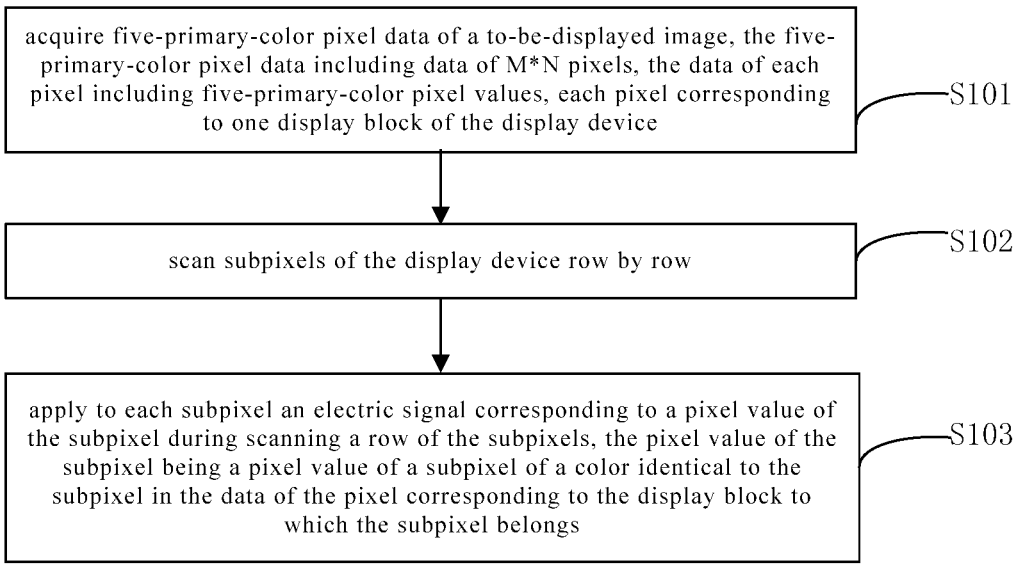
FIG. 7 is a flow chart of a display method according to some embodiments of the present disclosure.

As shown in FIG. 7, the display method includes: step S101 of acquiring five-primary-color pixel data of a to-be-displayed image, the five-primary-color pixel data including data of M*N pixels, the data of each pixel including five-primary-color pixel values, each pixel corresponding to one display block of the display device; step S102 of scanning subpixels of the display device row by row; and step S103 of applying to each subpixel an electric signal corresponding to a pixel value of the subpixel during scanning a row of the subpixels. The pixel value of the subpixel is a pixel value of a subpixel of a color identical to the subpixel in the data of the pixel corresponding to the display block to which the subpixel belongs.

To be specific, as shown in FIG. 2, the display method will be described hereinafter in detail by taking one of the first display blocks as an example.

The five-primary-color pixel values corresponding to the first display block 10 may be acquired at first. Then, the subpixels in a first row of the first display block 10 may be scanned. Next, the first subpixel 101 (R), the second subpixel 102 (G) and the third subpixel 103 (B) of the first display block 10 are respectively inputted with pixel values of an identical color (i.e., a red pixel value, a green pixel value or a blue pixel value), and when subpixels in a second row of the first display block 10 are scanned, the fourth subpixel 104 (C) and the fifth subpixel 105 (Y) of the first display block 10 are respectively inputted with pixel values of an identical color (i.e., a cyan pixel value or a yellow pixel value). The displaying procedure for the second display block 20 is identical to that for the first display block 10, and thus will not be repeated herein.

Figure 8A:
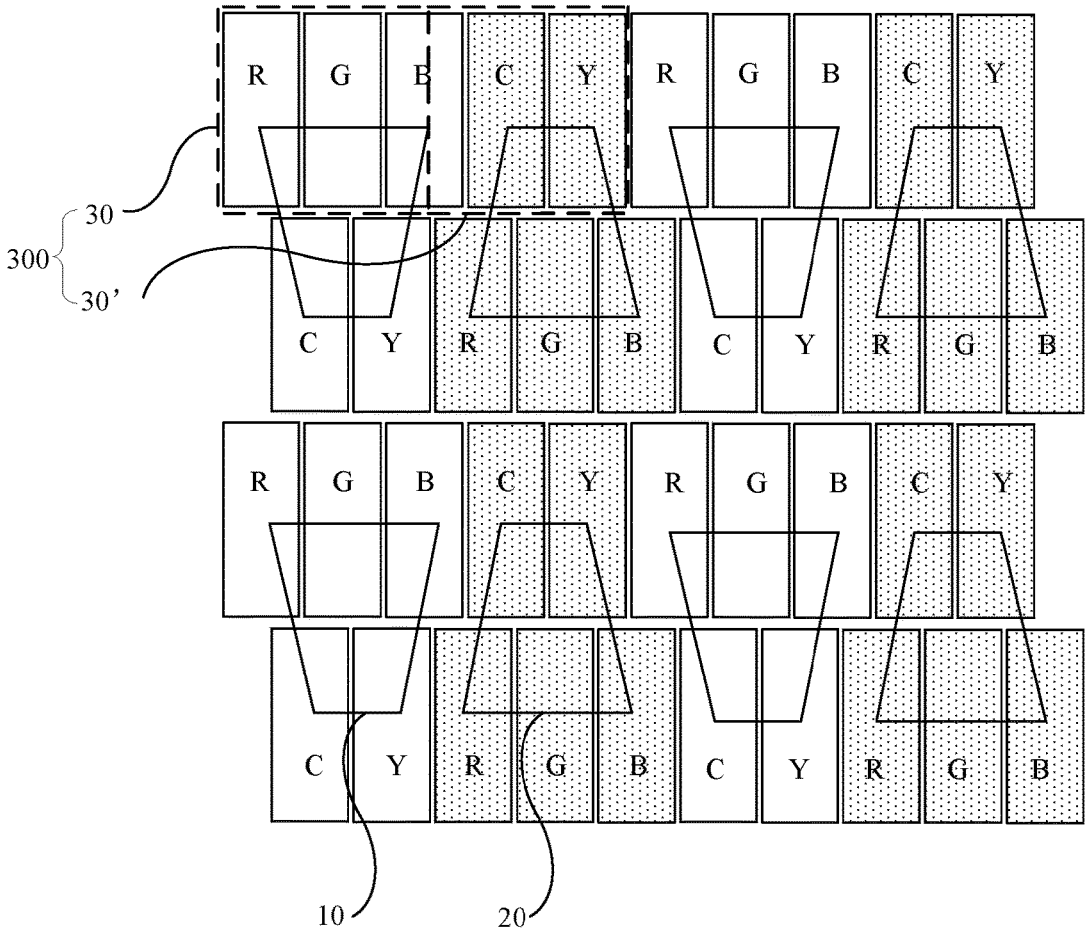
FIG. 8*a* is a schematic view showing the distribution of an actual pixel unit according to some embodiments of the present disclosure.

The present disclosure further provides in some embodiments another display method for the above-mentioned display device. As shown in FIG. 8*a*, the display device includes M*2N display blocks, where M represents the number of rows, and the 2N presents the number of columns.

Every five adjacent subpixels of the display device in a row direction form an actual pixel unit group 300, and every 2.5 adjacent subpixels in the actual pixel unit group 300 form the actual pixel unit 30. For example, in the event that the ratio of the length of the subpixel in the first direction X-X' to the length of the subpixel in the second direction Y-Y' is 0.4, the 2.5 subpixels may form a minimum square display unit, i.e., the actual pixel unit. In this way, as shown in FIG. 8*a*, one actual pixel unit group 300 may include two adjacent actual pixel units (30 and 30'), and the M*2N display blocks correspond to 2M*2N actual pixel units.

Figure 9:
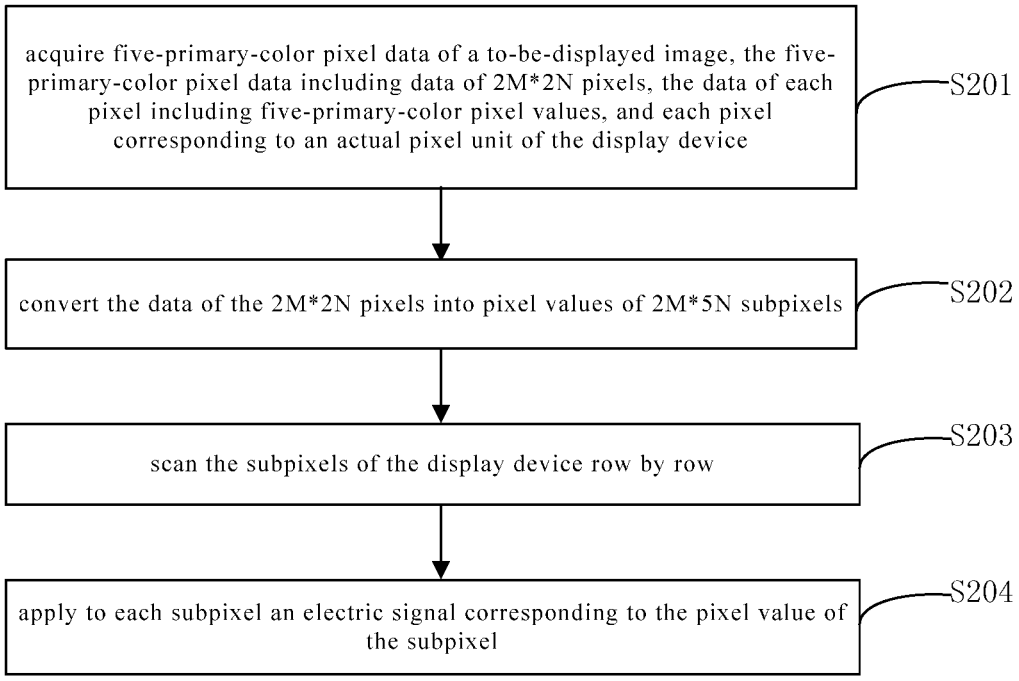
FIG. 9 is a schematic view showing another display method according to some embodiments of the present disclosure.

As shown in FIG. 9, the display method may include the following steps.

Step S201: acquire five-primary-color pixel data of a to-be-displayed image. The five-primary-color pixel data include data of 2M*2N pixels, the data of each pixel include five-primary-color pixel values, and each pixel corresponds to an actual pixel unit of the display device.

Step S202: convert the data of the 2M*2N pixels into pixel values of 2M*5N subpixels.

It should be appreciated that, theoretically the 2M*2N pixels correspond to 2M*10N pieces of pixel data, and the 2M*2N actual pixel units 30 actually include 2M*5N subpixels, i.e., adjacent actual pixel units 30 need to share the subpixels so as to display the image normally. Hence, it is necessary to perform a rendering operation on the 2M*2N pieces of pixel data for the 2M*2N pixels, so as to acquire the pixel values of the 2M*5N subpixels.

For example, the step S202 of converting the data of the 2M*2N pixels into the pixel values of the 2M*5N subpixels may include performing a weighted addition of the pixels values of subpixels in an identical specific color in the data of two pixels corresponding to one actual pixel unit group 300, so as to acquire the pixel value of the subpixels of the specific color in the actual pixel unit group 300. The specific color may be a first primary color, a second primary color, a third primary color, a fourth primary color or a fifth primary color, e.g., red, green, blue, cyan or yellow.

Figure 8B:
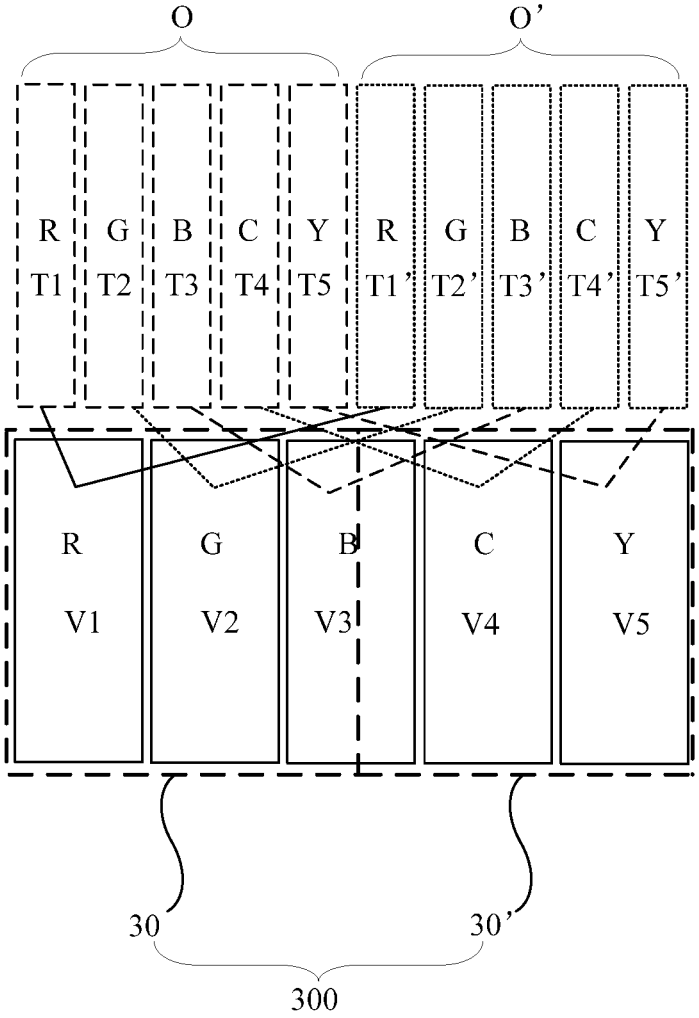
FIG. 8*b* is a schematic view showing an actual pixel unit acquired after the conversion of pixel data according to some embodiments of the present disclosure.

For example, as shown in FIG. 8*b*, the two adjacent actual pixel units (30 and 30') in one actual pixel unit group 300 may correspond to the data of two pixels (O and O'). In the data of the two pixels (O and O'), the red pixel values, the green pixel values, the blue pixel values, the cyan pixel values and the yellow pixel values may be (T1, T2, T3, T4, T5) and (T1', T2', T3', T4', T5'). The weighted addition may be performed for the pixel values of the subpixels of an identical color in the data of the adjacent pixels, so as to acquire the pixel value (V1, V2, V3, V4 or V5) of the subpixels of a specific color in the actual pixel unit group 300. Taking the red subpixel as an example, the pixel value V1 of the red subpixels in the actual pixel unit group 300 may be acquired through the weighted addition of T1 and T1'.

The above description is given by taking performing a weighted addition of the pixels values of subpixels of an identical specific color in the data of two adjacent pixels in the row direction as an example. Certainly, in the embodiments of the present disclosure, the weighted addition may also be performed for the pixel values of subpixels of an identical specific color in the data of the two adjacent pixels in a column direction, which will not be repeated herein. During the actual display, an appropriate pixel rendering method may be selected based on the actual requirements.

Step S203: scan the subpixels of the display device row by row.

Step S204: apply to each subpixel an electric signal corresponding to the pixel value of the subpixel.

It should be appreciated that, it is possible to improve the color uniformity of the image using the pixel array in the embodiments of the present disclosure, regardless of the display methods.

The above relates to some optional embodiments of the present disclosure, but the present disclosure is not limited thereto. Evidently, a person skilled in the art may make further modifications and improvements without departing from the present disclosure, and these modifications and improvements shall also fall within the scope of the present disclosure.

What is claimed is:

1. A display method for a display device comprising M*2N display blocks, wherein the display device further comprises a pixel array comprising first display blocks and second display blocks arranged in an array; the first display blocks and the second display blocks are arranged by turns in a first direction; each of the first display blocks and the second display blocks comprises a first subpixel, a second subpixel, a third subpixel, a fourth subpixel, and a fifth subpixel arranged in two adjacent lines, the first subpixel, the second subpixel, and the third subpixel are arranged in a line, and the fourth subpixel and the fifth subpixel are arranged in a line; in a group of the first display block and the second display block arranged adjacent to each other in the first direction, the first subpixel, the second subpixel, and the third subpixel of the first display block and the fourth subpixel and the fifth subpixel of the second display block are arranged in a line, and the fourth subpixel and the fifth subpixel of the first display block and the first subpixel, the second subpixel, and the third subpixel of the second display block are arranged in a line; and a gap between any two adjacent subpixels in an $i^{th}$ line is aligned in an extension direction of the gap with a subpixel in an $(i+1)^{th}$ line, where i is a positive integer, wherein a ratio of a length of each subpixel in the first direction to a length of the subpixel in a second direction perpendicular to the first direction is 0.4, so that every five adjacent subpixels in a row direction form an actual pixel unit group, and every 2.5 adjacent subpixels in the actual pixel unit group form an actual pixel unit;

the display method comprising:

acquiring five-primary-color pixel data of a to-be-displayed image, the five-primary-color pixel data comprising data of 2M*2N pixels, the data of each pixel comprising five-primary-color pixel values, each pixel corresponding to an actual pixel unit of the display device;

converting the data of the 2M*2N pixels into pixel values of 2M*5N subpixels;

scanning the subpixels of the display device row by row; and applying to each subpixel an electric signal corresponding to the pixel value of the subpixel, during scanning a row of the subpixels.

2. The display method according to claim 1, wherein the converting the data of the 2M*2N pixels into the pixel values of the 2M*5N subpixels further comprises: performing a weighted addition of the pixels values of subpixels of an identical specific color in the data of two pixels corresponding to one actual pixel unit group to acquire the pixel value of the subpixels of the specific color in the actual pixel unit group, and the specific color is a first primary color, a second primary color, a third primary color, a fourth primary color or a fifth primary color.

* * * * *